US012650275B2

(12) United States Patent
Perle et al.

(10) Patent No.: US 12,650,275 B2
(45) Date of Patent: Jun. 9, 2026

(54) FIREARM WITH BUFFER ASSEMBLY

(71) Applicants: Collin M. Perle, Plainfield, IL (US); Nathaniel J. Perle, Plainfield, IL (US)

(72) Inventors: Collin M. Perle, Plainfield, IL (US); Nathaniel J. Perle, Plainfield, IL (US)

( * ) Notice: Subject to any disclaimer, the term of this patent is extended or adjusted under 35 U.S.C. 154(b) by 0 days.

(21) Appl. No.: 18/405,336

(22) Filed: Jan. 5, 2024

(65) Prior Publication Data

US 2024/0230259 A1 Jul. 11, 2024

Related U.S. Application Data

(60) Provisional application No. 63/438,097, filed on Jan. 10, 2023.

(51) Int. Cl.
*F41A 3/90* (2006.01)

(52) U.S. Cl.
CPC ..... *F41A 3/90* (2013.01)

(58) Field of Classification Search
CPC ..... F41A 3/90; F41A 3/92; F41A 3/94
USPC ..... 89/198
See application file for complete search history.

(56) References Cited

U.S. PATENT DOCUMENTS 3,517,586 A * 6/1970 Stoner ..... F41A 19/33 89/198
3,977,296 A * 8/1976 Silsby ..... F41A 3/94 89/198
4,729,280 A * 3/1988 Metz ..... F41A 25/02 89/43.01
6,758,126 B1 * 7/2004 Houtsma ..... F41A 3/94 42/1.06
7,131,367 B1 11/2006 Boerschig et al.
11,629,923 B2 4/2023 Graves
2012/0180648 A1 * 7/2012 Sullivan ..... F41A 13/12 89/193
2016/0370135 A1 * 12/2016 Plumb ..... F41A 3/90
2017/0115078 A1 4/2017 Plumb
2017/0314635 A1 * 11/2017 Koscielniak ..... F41A 19/03

OTHER PUBLICATIONS

Flgunguy, "HK93 bolt carrier vs HK33 bolt carrier," Sturmgewehr.com, https://www.sturmgewehr.com/forums/index.php?/topic/22360-hk93-bolt-carrier-vs-hk33-bolt-carrier/, Aug. 5, 2021, Accessed Nov. 16, 2023.

* cited by examiner

*Primary Examiner* — Bret Hayes
(74) *Attorney, Agent, or Firm* — Bennet K. Langlotz; Langlotz Patent & Trademark Works, LLC

(57) ABSTRACT

A firearm with buffer assembly has a frame, a bolt assembly operable to reciprocate with respect to the frame between a forward battery position and a rearward recoil position, and the bolt assembly including a hydraulic damper assembly. The hydraulic damper assembly may include at least a first portion connected to the bolt assembly. The first portion of the hydraulic damper assembly may be fixed to the bolt assembly such that the first portion does not move with respect to the bolt assembly in response to forces applied in the forward and rearward direction. The entire hydraulic damper assembly may reciprocate with the bolt assembly. The hydraulic damper assembly is operable to provide damping in response to the bolt assembly striking the frame upon reaching the forward battery position and in response to the bolt assembly striking the frame upon reaching the rearward recoil position.

14 Claims, 8 Drawing Sheets

FIREARM WITH BUFFER ASSEMBLY

CROSS-REFERENCE TO RELATED APPLICATION

This application claims the benefit of U.S. Provisional Patent Application No. 63/438,097 filed on Jan. 10, 2023, entitled "BOLT CARRIER WITH REMOVABLE ANTI-BOUNCE HYDRAULIC BUFFER ASSEMBLY," which is hereby incorporated by reference in its entirety for all that is taught and disclosed therein.

FIELD OF THE INVENTION

The present invention relates to firearms, and more particularly to a firearm with buffer assembly that reduces both recoil impulse and bolt bounce using a single buffer assembly.

BACKGROUND AND SUMMARY OF THE INVENTION

Reducing recoil impulse in firearms has been a long-studied topic with various solutions throughout the years. One common method is a recoil spring, or a series of springs, which are used to spread the impulse over a longer duration, often extending forward from the rear of the firearm, or from within the stock, and terminating at the bolt carrier assembly. Rubber pads are also commonly used at the rear of the firearm behind the bolt carrier assembly to provide a softer impact surface for the bolt carrier assembly to impact upon achieving its full rearward travel. Finally, hydraulic buffers have been successfully used to reduce the recoil impulse; however, these are typically mounted inside a stock, or behind the bolt carrier assembly. As is described in U.S. Pat. No. 7,131,367 to Boerschig et al., which is herein incorporated by reference in its entirety for all that is taught and disclosed therein, there are accuracy challenges associated with automatic firearms, particularly when longer bursts are fired. Specifically, recoil of follow on rounds cause the barrel to climb upward and to the right. Boerschig et al. teaches a hydraulic bolt buffer assembly that addresses this problem. However, the Boerschig et al. invention only operates in the recoil state and does not affect the chambering impact that can cause undesirable bolt bounce.

Bolt bounce, or the phenomenon where a bolt carrier assembly will bounce away from the fully forward, or battery, position upon impact with the barrel assembly, is a well-known problem for fast follow up shots and especially for fully automatic fire. Bolt bounce can create dangerous situations for the shooter such as an out-of-battery-discharge where the cartridge will ignite while the bolt is not properly locked into the breech, or a failure-to-fire where the round is not ignited upon the impact of the firing pin. The bolt bounce problem has been addressed in a multitude of ways historically, typically by adding freely moving weights of proper mass and shape to provide a secondary impact of the weights after the bolt carrier assembly initially impacts the barrel assembly, thus providing a secondary force to keep the bolt carrier assembly fully in battery position. However, previous approaches use a separate set of components distinct from those used to address recoil impulse, which can require the firearm to be longer and to potentially require a stock to provide adequate space. These space requirements make many prior art approaches unsuitable for use in pistols and short format rifles. Furthermore, many prior art solutions address only recoil impulse or bolt bounce rather than both phenomena.

Therefore, a need exists for a new and improved firearm with buffer assembly that enables a firearm to reduce both recoil impulse and bolt bounce using a single buffer assembly. In this regard, the various embodiments of the present invention substantially fulfill at least some of these needs. In this respect, the firearm with buffer assembly according to the present invention substantially departs from the conventional concepts and designs of the prior art, and in doing so provides an apparatus primarily developed for the purpose of enabling a firearm to reduce both recoil impulse and bolt bounce using a single buffer assembly.

The present invention provides an improved firearm with buffer assembly, and overcomes the above-mentioned disadvantages and drawbacks of the prior art. As such, the general purpose of the present invention, which will be described subsequently in greater detail, is to provide an improved firearm with buffer assembly that has all the advantages of the prior art mentioned above.

To attain this, the preferred embodiment of the present invention essentially comprises a frame, a bolt assembly operable to reciprocate with respect to the frame between a forward battery position and a rearward recoil position, and the bolt assembly including a hydraulic damper assembly. The hydraulic damper assembly may include at least a first portion connected to the bolt assembly. The first portion of the hydraulic damper assembly may be fixed to the bolt assembly such that the first portion does not move with respect to the bolt assembly in response to forces applied in the forward and rearward direction. The entire hydraulic damper assembly may reciprocate with the bolt assembly. The hydraulic damper assembly is operable to provide damping in response to the bolt assembly striking the frame upon reaching the forward battery position. The hydraulic damper assembly is operable to provide damping in response to the bolt assembly striking the backplate portion of the frame upon reaching the rearward recoil position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
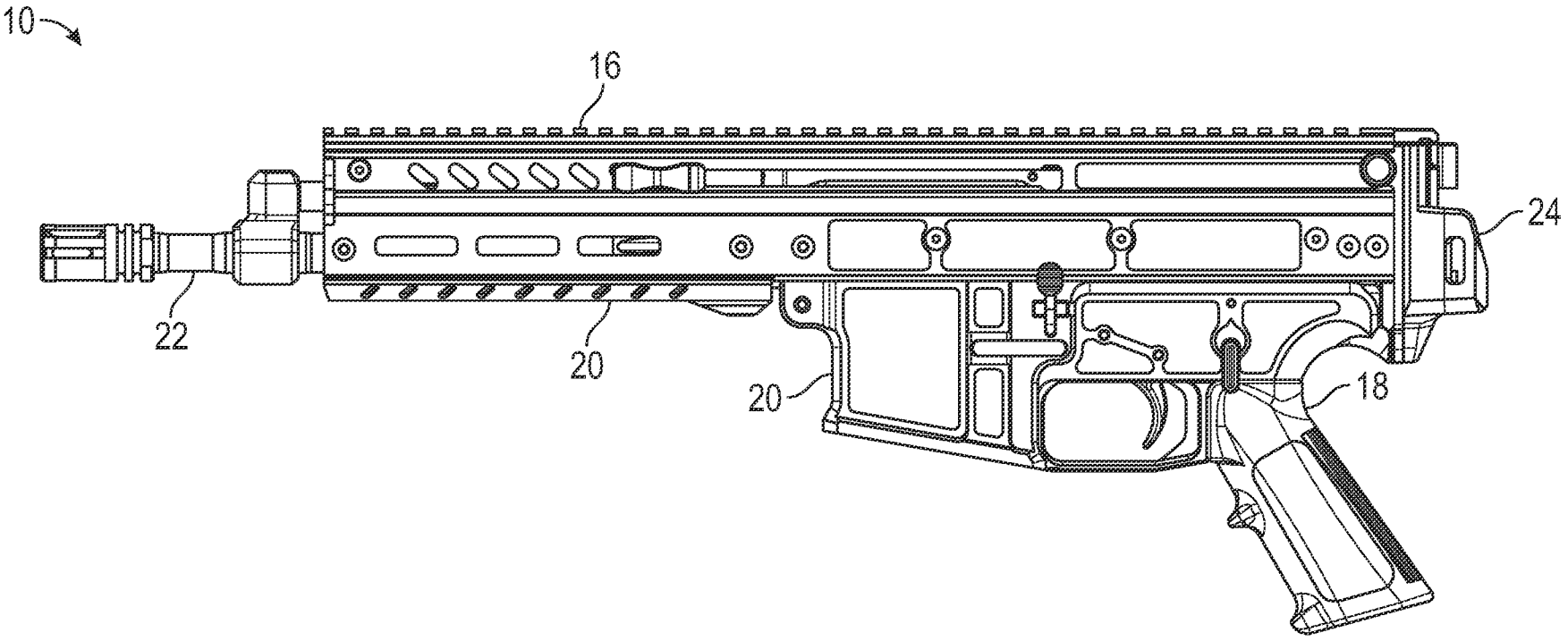
FIG. 1 is a left side view of the current embodiment of a firearm with buffer assembly constructed in accordance with the principles of the present invention forming a complete rifle.

An embodiment of the firearm with buffer assembly of the present invention is shown and generally designated by the reference numeral 10.

Figure 2:
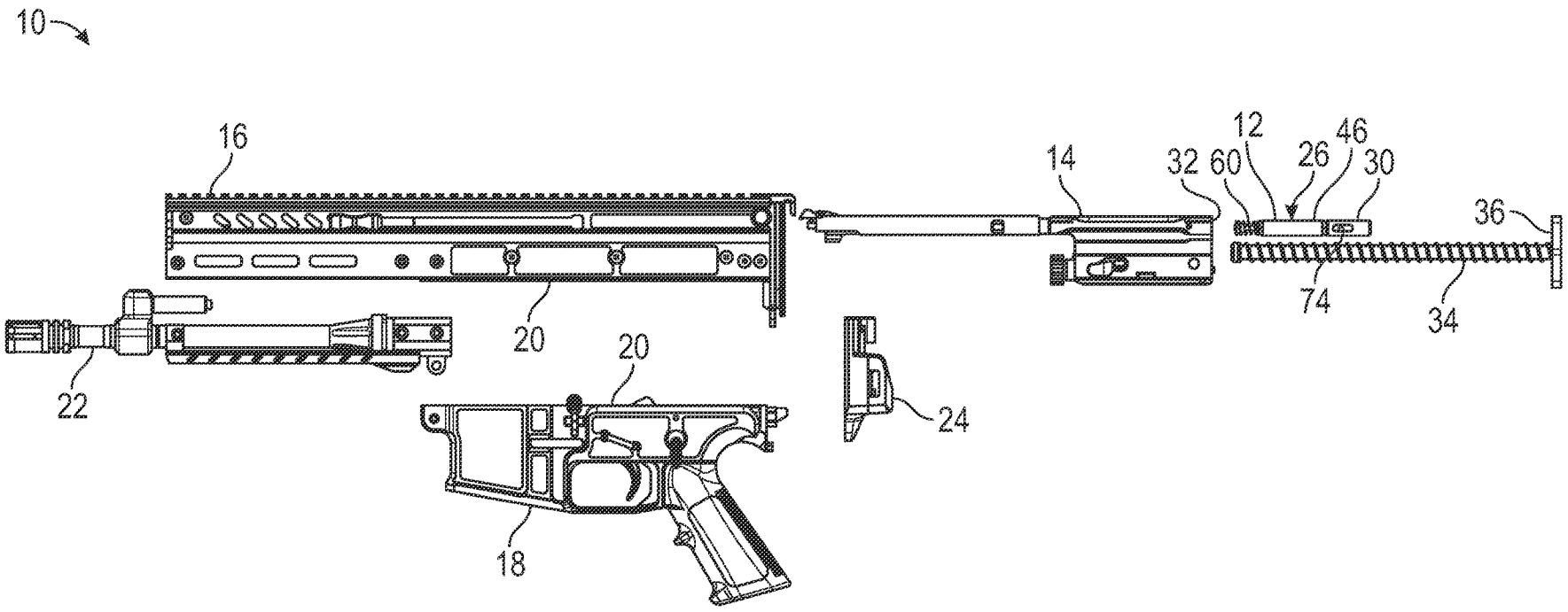
FIG. 2 is an exploded view of the lower receiver assembly of the firearm with buffer assembly of FIG. 1.
Figure 3:
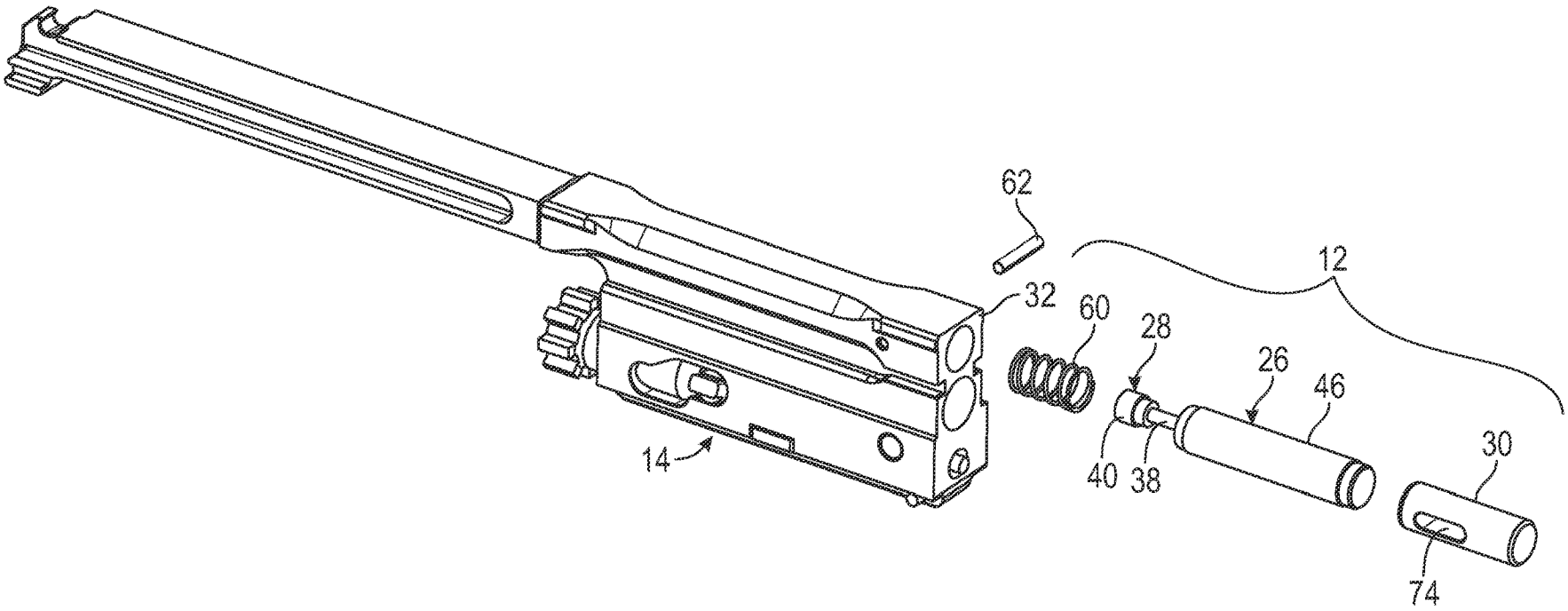
FIG. 3 is a top isometric exploded view of the buffer assembly and bolt assembly of FIG. 2.
Figure 4:
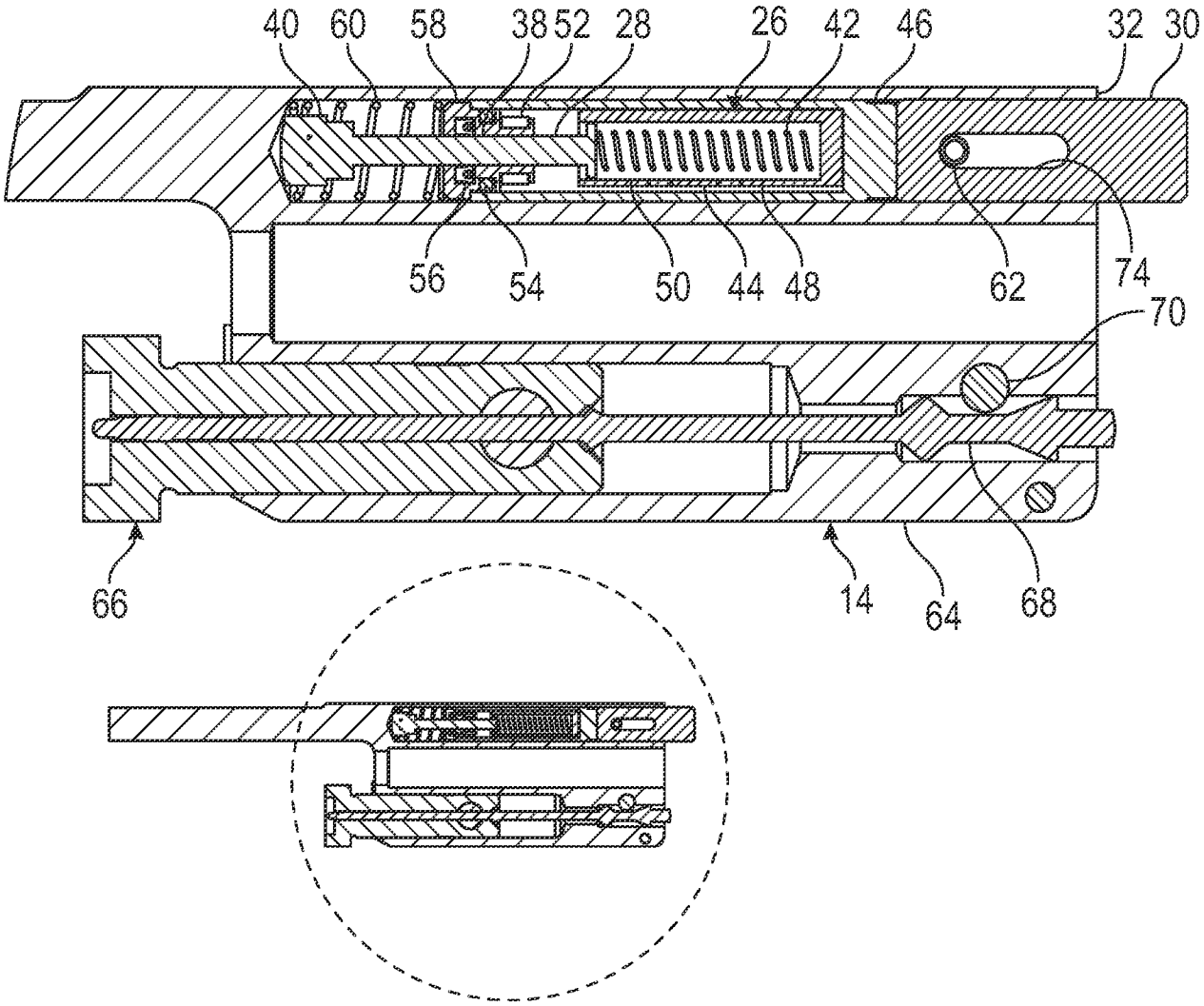
FIG. 4 is an enlarged partial side sectional view of the buffer assembly and bolt assembly of FIG. 2.
Figure 5:
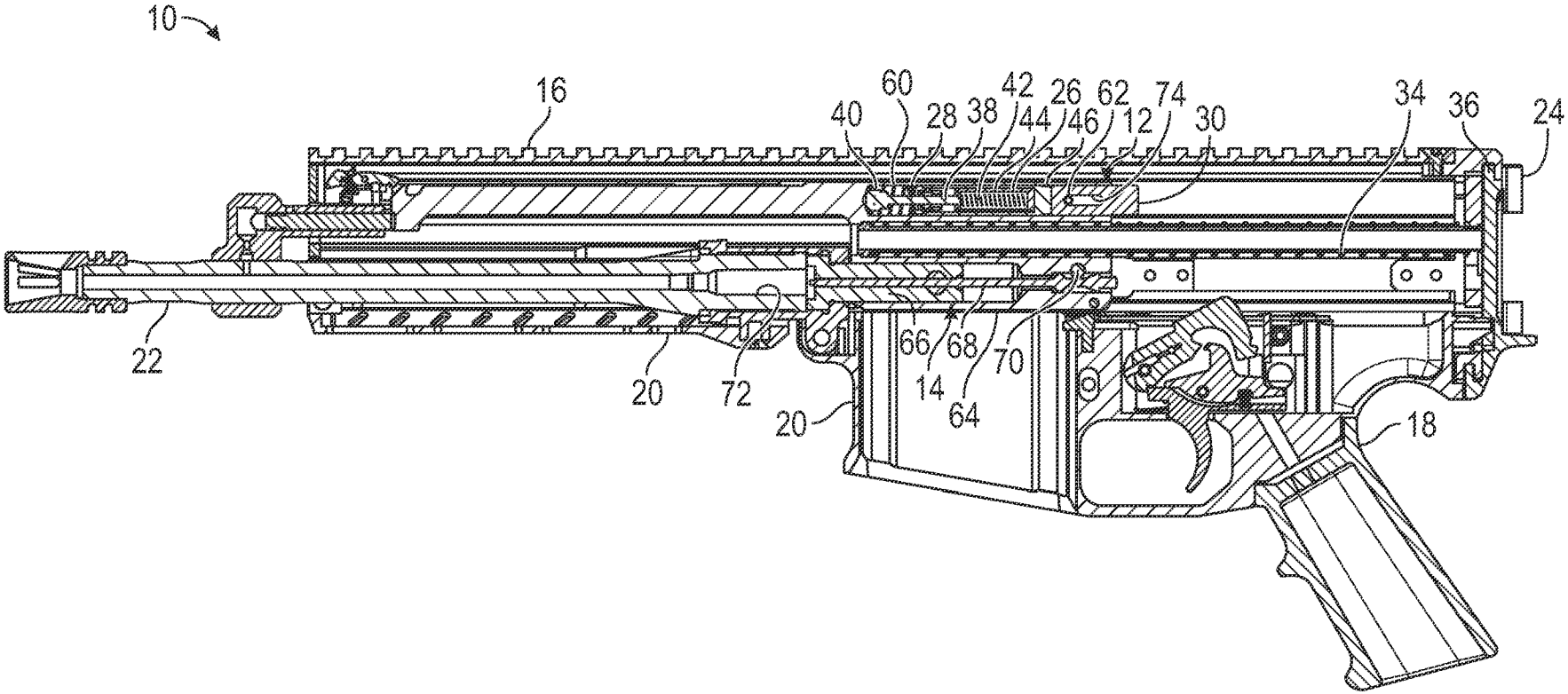
FIG. 5 is a side sectional view of the firearm with buffer assembly of FIG. 1.

FIGS. 1, 2, & 5 illustrate the improved firearm with buffer assembly 10 of the present invention. FIGS. 3 & 4 illustrate an improved buffer assembly 12 and bolt assembly 14. More particularly, the firearm with buffer assembly has an upper receiver assembly 16 and a lower receiver assembly 18 that are connected to form a frame 20. The firearm with buffer assembly also includes a barrel assembly 22 and a return spring retainer 24. The buffer assembly and bolt assembly are received within the frame. The bolt assembly is operable to reciprocate with respect to the frame between a forward battery position and a rearward recoil position. The buffer assembly includes a hydraulic damper assembly 26, a return spring 34, and a rubber-buffered backplate 36.

In the current embodiment, the hydraulic damper assembly 26 includes at least a first portion (piston 28) connected to the bolt assembly 14. The first portion of the hydraulic damper assembly is fixed to the bolt assembly such that the first portion does not move with respect to the bolt assembly in response to forces applied in the forward and rearward direction in the current embodiment. The piston has a piston shaft 38 and a removable head 40 that also acts as an anti-bolt bounce weight. In the current embodiment, the hydraulic damper assembly is a MC 75-1 miniature shock absorber manufactured by ACE Controls, Inc. of Farmington Hills, MI.

The hydraulic damper assembly also has a piston return spring 42, and orifice housing 44, a housing 46, and orifice 48, and oil return path 50, an accumulator 52, a seal 54, a cup seal 56, and an end cap 58. An optional auxiliary return spring 60 may encompass the portion of the piston protruding from the housing. The plunger 30 abuts the housing and defines a slot 74. A retaining pin 62 is received within the slot and connects the plunger to the bolt assembly. The slot defines a range of motion of the plunger within the bolt assembly.

The bolt assembly 14 includes a bolt carrier 64 that receives a reciprocating bolt 66. The bolt carrier also receives a firing pin 68 that is retained within the bolt carrier by a firing pin retainer 70. When the bolt assembly has reached the forwardmost position, the bolt contacts the barrel assembly 22 to secure a loaded round (not shown) within a chamber 72 defined by the barrel assembly.

The entire hydraulic damper assembly 26 reciprocates with the bolt assembly 14. The hydraulic damper assembly is operable to provide damping in response to the bolt assembly striking the barrel assembly 22 portion of the frame 20 upon reaching the forward battery position. The hydraulic damper assembly is also operable to provide damping in response to the bolt assembly striking the backplate 36 portion of the frame upon reaching the rearward recoil position. A weight (plunger 30) is located rearward of the hydraulic damper assembly. The weight is movable with respect to the bolt assembly and interfaces the bolt assembly by way of the hydraulic damper assembly. The weight protrudes from the rear 32 of the bolt assembly. Upon movement of the bolt assembly to the rearward recoil position, the weight initially contacts the backplate portion of the frame, such that subsequent rearward movement of the bolt assembly is damped.

The buffer assembly 12 solves both the problems of recoil impulse and bolt balance in a unique way. The hydraulic damper assembly 26 is mounted within the bolt assembly 14 rather than inside a stock or pressed against the rear of the bolt assembly via a recoil spring like past solutions. The plunger 30 functions as an anti-bolt bounce weight and is located to enable the buffer assembly to actuate both during recoil and during chambering.

Figure 6:
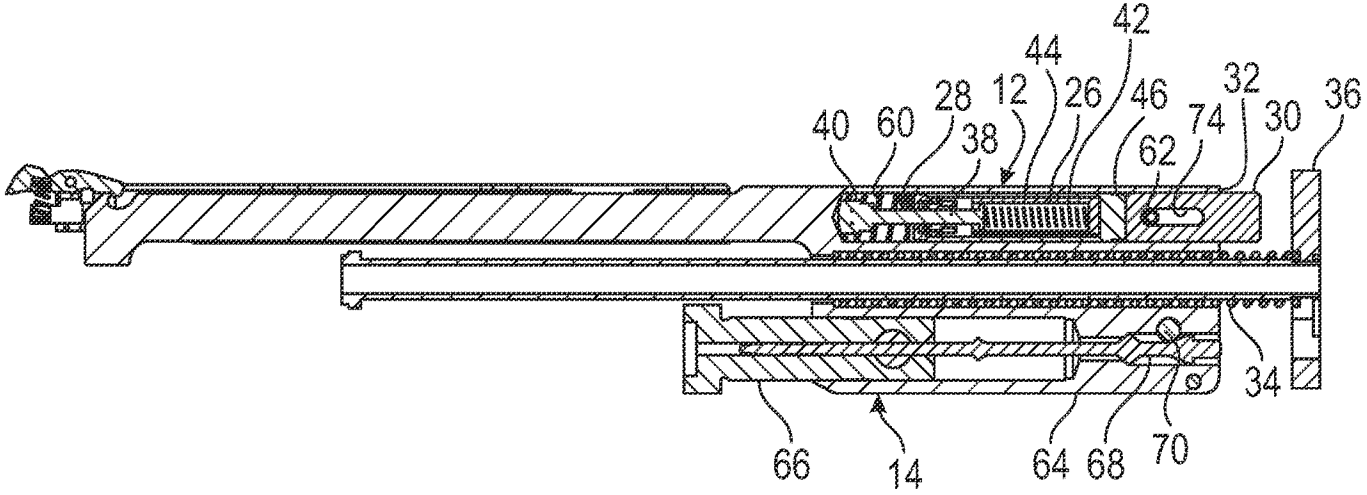
FIG. 6 is a side sectional view of the buffer assembly and bolt assembly of FIG. 2 starting to recoil after a round has been fired.
Figure 7:
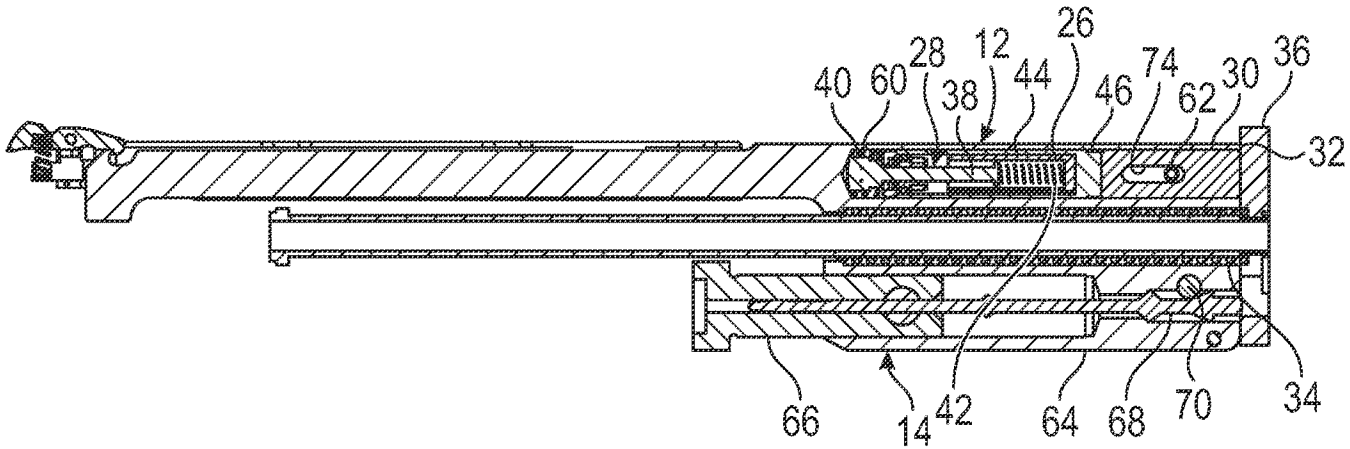
FIG. 7 is a side sectional view of the buffer assembly and bolt assembly of FIG. 2 at the point of maximum recoil after a round has been fired.
Figure 8:
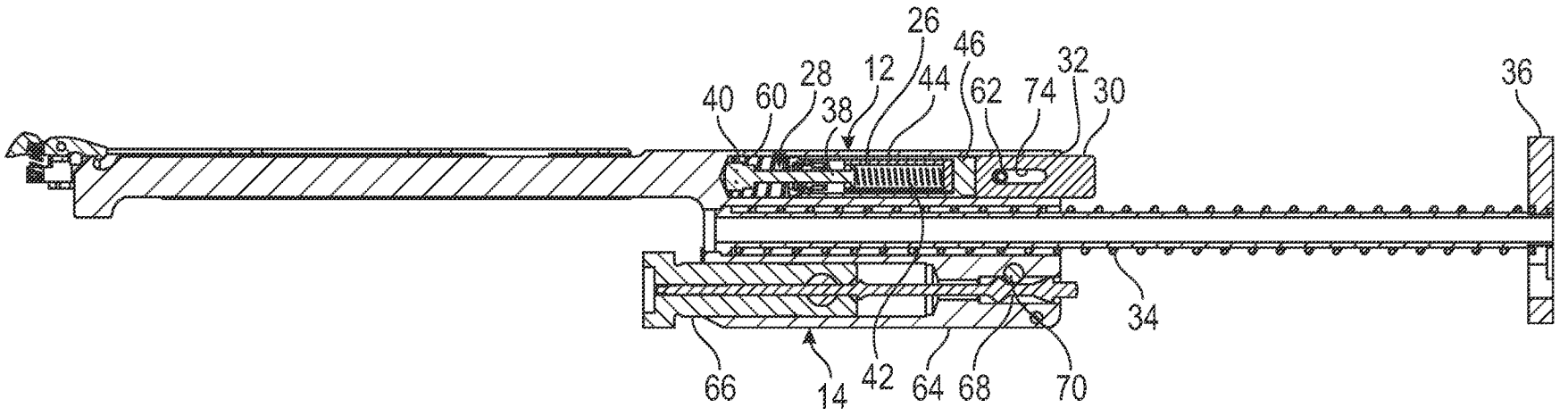
FIG. 8 is a side sectional view of the buffer assembly and bolt assembly of FIG. 2 with the bolt assembly having reached the forwardmost position. The buffer assembly has not yet reached the forwardmost position.
Figure 9:
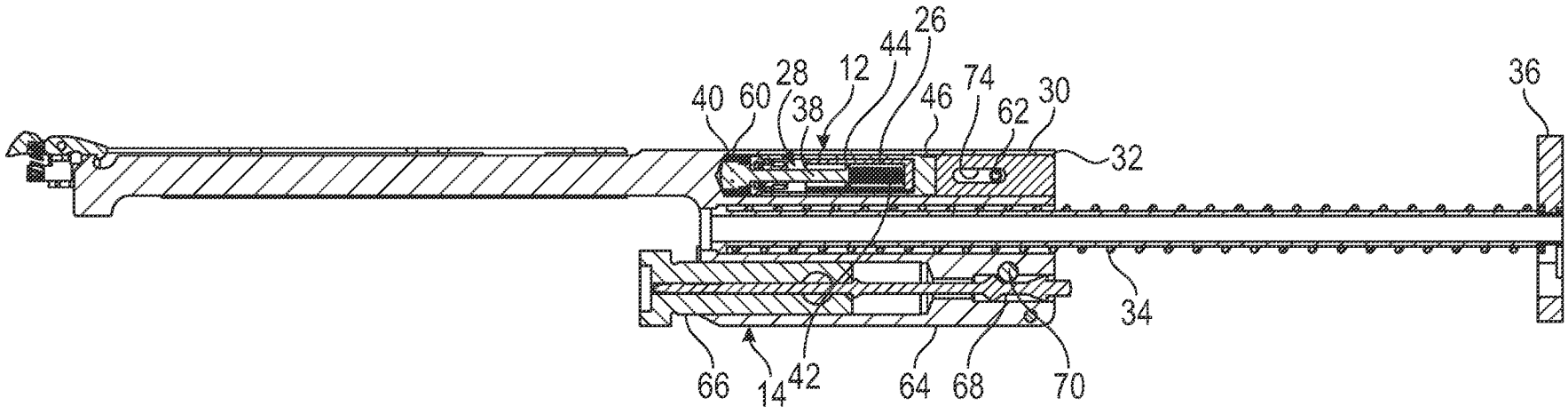
FIG. 9 is a side sectional view of the buffer assembly and bolt assembly of FIG. 2 with the bolt assembly having reached the forwardmost position. The buffer assembly has also reached the forwardmost position.

FIGS. 6-9 illustrate the improved buffer assembly 12 and bolt assembly 14. More particularly, FIG. 6 shows the buffer assembly and bolt assembly starting to recoil after a round has been fired. The return spring 34 is partially compressed against the backplate 36. The piston 28 is in a fully extended, uncompressed state that pushes the plunger 30 to the rearmost extent of travel governed by the interaction between the slot 74 and the retaining pin 62. In the rearmost extent of travel, the plunger protrudes from the rear 32 of the bolt assembly. FIG. 7 shows the buffer assembly and bolt assembly at the point of maximum recoil after a round has been fired. The piston is fully compressed between the bolt assembly and the plunger, and the return spring is 34 is compressed. FIG. 8 shows the buffer assembly and bolt assembly with the bolt assembly having reached the forwardmost position. The buffer assembly has not yet reached the forwardmost position. FIG. 9 shows the buffer assembly and bolt assembly with the bolt assembly having reached the forwardmost position. The buffer assembly has also reached the forwardmost position. In the transition from FIG. 8 to FIG. 9, the plunger has provided a secondary inertial forward force after the bolt carrier 64 has impacted the barrel assembly 22. The secondary forward force acts on the bolt assembly via the hydraulic damper assembly, thereby creating a hydraulically-buffered anti-bolt bounce action by partially compressing the piston against the bolt assembly. Subsequently, the piston returns to its fully extended, uncompressed state.

The first actuation of the buffer assembly 12 occurs at the traditional point of the firing cycle: near the end of rearward travel of the bolt assembly 14. The plunger 30 is preferably located behind the hydraulic damper assembly 26, and upon nearly full rearward travel of the bolt assembly, the plunger first impacts the rear of the firearm before the rest of the bolt assembly. The weight then begins to actuate the hydraulic damper assembly and slows the bolt assembly down before the bolt assembly reaches the full rearward travel position by impacting the backplate 36 portion of the frame 20 of the firearm. This action provides multiple benefits because it reduces the recoil impulse to the shooter to provide an improved shooting experience by allowing faster follow-up shots by providing increased control of the firearm during recoil, and reducing fatigue experienced by the shooter. The return spring 34 is also compressed against the backplate 36.

The second actuation of the buffer assembly 12 is at the full forward travel, or battery position, of the bolt assembly 14. Forward travel of the bolt assembly is initiated by the return spring 34. The plunger 30 is designed to have sufficient forward movement so that as the bolt assembly impacts the barrel assembly 22, the plunger, because of inertia, will continue to move forward. Instead of imparting a force directly onto the bolt assembly as older anti-bolt bounce designs operate, the plunger instead begins to actuate the hydraulic damper assembly 26 a second time. This activation creates a buffered anti-bounce action to keep the bolt assembly fully in battery and prevent a catastrophic, out of battery detonation.

Figure 10:
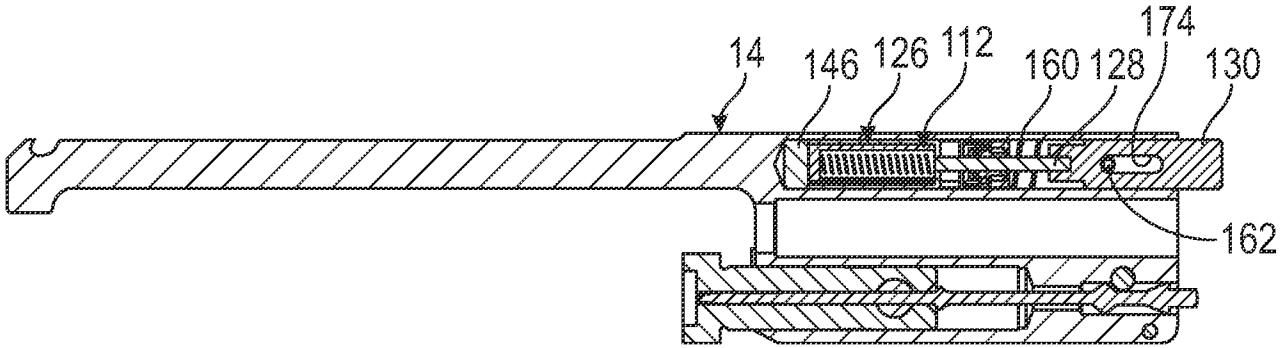
FIG. 10 is a side sectional view of an alternative embodiment of the buffer assembly constructed in accordance with the principles of the present invention.

FIG. 10 illustrates an alternative embodiment of the buffer assembly 112 received within the bolt assembly 14. In the alternative embodiment, the hydraulic damper assembly 126 is reversed such that the piston is attached to the plunger 130. An optional auxiliary return spring 160 may encompass the portion of the piston protruding from the housing 146 of the hydraulic damper assembly. The plunger abuts the housing and defines a slot 174. A retaining pin 162 is received within the slot and connects the plunger to the bolt assembly. The slot defines a range of motion of the plunger within the bolt assembly.

It should be appreciated that the hydraulic damper assembly also acts as a rate of fire reducer. This is because the hydraulic damper assembly resists the motion of the bolt carrier because of inertial forces, as well as the direct damping forces occurring at the last moments of full rearward travel while the hydraulic damper assembly is compressing. Overall, the firearm takes more time to cycle, resulting in a decreased rate of fire, which has a multitude of positive effects. These include improved controllability for the shooter, conservation of ammunition in sustained shooting situations, as well as less heat input to the barrel over time, resulting in less wear and longer life.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While current embodiments of a firearm with buffer assembly have been described in detail, it should be apparent that modifications and variations thereto are possible, all of which fall within the true spirit and scope of the invention. For example, the quantity and location of plungers/anti-bounce weights can vary. Furthermore, the plunger can be made of a variety of materials of different densities to achieve the desired weight and dimensions, including steel and tungsten. Furthermore, the plunger can be made integrally whole with the piston body as a unitary component to form a weighted hydraulic damper assembly. Furthermore, the piston can be replaced with a composition of springs, springs and rubber, polymer, or rubber. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A firearm comprising:

a frame;

a bolt assembly operable to reciprocate with respect to the frame between a forward battery position and a rearward recoil position; and the bolt assembly including a hydraulic damper assembly connected directly to the bolt assembly to reciprocate with the bolt assembly.

2. The firearm of claim 1 wherein the hydraulic damper assembly is fixed to the bolt assembly such that the hydraulic damper assembly does not move with respect to the bolt assembly in response to forces applied in the forward and rearward direction.

3. The firearm of claim 1 wherein the hydraulic damper assembly reciprocates with the bolt assembly.

4. The firearm of claim 1 wherein the hydraulic damper assembly is operable to provide damping in response to the bolt assembly striking the frame upon reaching the forward battery position.

5. The firearm of claim 1 wherein the hydraulic damper assembly is operable to provide damping in response to the bolt assembly striking the frame upon reaching the rearward recoil position.

6. The firearm of claim 1 including a weight rearward of the hydraulic damper assembly, the weight being movable with respect to the bolt assembly, and interfacing the bolt assembly by way of the hydraulic damper assembly.

7. The firearm of claim 6 wherein the weight protrudes from a rear of the bolt assembly.

8. The firearm of claim 6 wherein upon movement of the bolt assembly to the rearward recoil position, the weight initially contacts the frame, such that subsequent rearward movement of the bolt assembly is damped.

9. The firearm of claim 1 wherein upon movement of the bolt assembly to the rearward recoil position, the hydraulic damper assembly initially contacts a backplate, such that subsequent rearward movement of the bolt assembly is damped.

10. The firearm of claim 1 wherein the bolt assembly includes a bolt carrier receiving a reciprocating bolt and having a firing pin.

11. A firearm comprising:

a frame;

a bolt assembly operable to reciprocate with respect to the frame between a forward battery position and a rearward recoil position; and the bolt assembly including a hydraulic damper assembly connected directly to the bolt assembly to reciprocate with the bolt assembly, the hydraulic damper assembly including a movable protrusion configured to directly strike the frame.

12. The firearm of claim 11 wherein the hydraulic damper assembly includes at least a first portion connected to the bolt assembly.

13. The firearm of claim 11 wherein the movable protrusion is a cylindrical element.

14. The firearm of claim 11 wherein the frame includes a rear portion having a strike surface facing in a forward direction and configured for striking by the movable protrusion.

* * * * *